US011118484B2

(12) United States Patent
Badellino et al.

(10) Patent No.: US 11,118,484 B2
(45) Date of Patent: Sep. 14, 2021

(54) VALVETRAIN SERVICE TOOL

(71) Applicant: GM Global Technology Operations LLC, Detroit, MI (US)

(72) Inventors: Gianfranco Badellino, Turin (IT); Fabrizio Binello, Turin (IT); Antonino Barresi, Turin (IT); Francesco Zangallo, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 71 days.

(21) Appl. No.: 16/447,127

(22) Filed: Jun. 20, 2019

(65) Prior Publication Data

US 2020/0400041 A1 Dec. 24, 2020

(51) Int. Cl.

| | |
|---|---|
| ***F01L 1/14*** | (2006.01) |
| ***B25B 27/24*** | (2006.01) |
| ***B25B 27/00*** | (2006.01) |

(52) U.S. Cl.

CPC ..... *F01L 1/14* (2013.01); *B25B 27/0035* (2013.01); *B25B 27/24* (2013.01); *F01L 2303/01* (2020.05); *F01N 2450/00* (2013.01)

(58) Field of Classification Search

CPC . F01L 1/14; F01L 2303/01; F01L 1/12; B25B 27/00; B25B 27/0007; B25B 27/0021; B25B 27/0035; B25B 27/0042; B25B 27/005; B25B 27/0057; B25B 27/0064; B25B 27/02; B25B 27/023; B25B 27/04; B25B 27/08; B25B 27/12; B25B 27/14; B25B 27/16; B25B 27/24; B25B 1/00; B25B 1/02; B25B 1/06; B25B 1/10; B25B 1/103; B25B 1/125; B25B 3/00; B25B 5/103; B25B 5/163; B25B 5/166; F01N 2450/00; B23Q 1/25; B23Q 1/28; B23Q 3/00; B23Q 3/002; B23Q 3/005; B23Q 3/007; B23Q 3/02; B23Q 3/06; B23Q 3/061; B23Q 3/062; B23Q 3/066; B23Q 3/069

See application file for complete search history.

(56) References Cited

U.S. PATENT DOCUMENTS

| | | | | | |
|---|---|---|---|---|---|
| 359,833 | A * | 3/1887 | Basinger | B25B 5/102 | 269/203 |
| 1,120,466 | A * | 12/1914 | Leopold | B25B 1/103 | 269/251 |
| 3,584,862 | A * | 6/1971 | Wilson | B25B 1/02 | 269/242 |
| 4,158,318 | A * | 6/1979 | Strametz | B25B 27/0035 | 254/10.5 |
| 2013/0187322 | A1* | 7/2013 | Woods | B25B 5/04 | 269/285 |
| 2017/0113336 | A1* | 4/2017 | Raby | F16J 1/18 | |

* cited by examiner

*Primary Examiner* — Robert J Scruggs

(57) ABSTRACT

A valvetrain service tool for an automobile engine comprises a bracket adapted to be removably mounted onto a structural member of an engine, and a pin slidably supported within the bracket, wherein, the pin is slidable between a first position and a second position, further wherein, when the pin is moved from the first position to the second position, the pin engages a cam sprocket of the engine to support the cam sprocket and allow service to be performed to the valvetrain of the engine without removing the cam sprocket.

14 Claims, 3 Drawing Sheets

VALVETRAIN SERVICE TOOL

INTRODUCTION

The present disclosure relates to a valvetrain service tool adapted to allow valvetrain components within an engine to be serviced without removing the cam sprocket from the engine. Currently, if there is a need to remove certain valvetrain components that are engaged with the cam sprocket from the engine, the cam sprocket must be removed first. This requires the removal of several other components related to the cam sprocket, such as timing chain, pulleys, belts, and covers. In many instances, these related components are mounted onto the engine in front of the cam sprocket requiring their removal to allow removal of the cam sprocket. This requires added time and effort, and therefore increases the cost of servicing valvetrain components, such as the cam shaft.

Therefore, there is a need for a valvetrain service tool that will support the cam sprocket in place to allow related valvetrain components, such as the cam shaft, to be removed, repaired and replaced, without requiring the cam sprocket and various other related components to be removed as well.

SUMMARY

According to several aspects of the present disclosure, a valvetrain service tool for an automobile engine comprises a bracket adapted to be removably mounted onto a structural member of an engine, and a pin slidably supported within the bracket, wherein, the pin is slidable between a first position and a second position, further wherein, when the pin is moved from the first position to the second position, the pin engages a cam sprocket of the engine to support the cam sprocket and allow service to be performed to the valvetrain of the engine without removing the cam sprocket.

According to another aspect, the bracket includes a hub having a cylindrical bore formed therein, the pin supported within the cylindrical bore and slidable longitudinally within the cylindrical bore.

According to another aspect, the bracket includes a slot formed therein, the slot extending longitudinally along the cylindrical bore, and the pin includes a stop extending radially from an outer diameter of the pin, the stop extending through the slot formed within the bracket, wherein the stop secures the pin within the cylindrical bore of the bracket and when the pin is in the first position the stop is adjacent a first end of the slot and when the pin is in the second position the stop is adjacent a second end of the slot.

According to another aspect, the stop is a set screw and the pin includes a threaded bore formed therein, the set screw being removably threaded within the threaded bore formed within the pin.

According to another aspect, the set screw further includes a textured head adapted to allow the set screw to be manually threaded into the threaded bore formed within the pin.

According to another aspect, the textured head of the set screw is further adapted to allow the set screw to be manually removed from the threaded bore formed within the pin to allow removal of the pin from the bracket.

According to another aspect, the pin includes a first distal end adapted to engage the cam sprocket of the engine and a second distal end, opposite the first distal end, wherein the pin includes a knob attached to the second distal end adapted to allow the pin to be manually moved within the cylindrical bore of the bracket.

According to another aspect, the second distal end of the pin includes a threaded nipple and the knob includes a threaded bore, further wherein the knob is held onto the pin by a threaded engagement of the threaded nipple within the threaded bore of the knob.

According to another aspect, the bracket includes at least one flange extending from the hub, the flange including a bore adapted to receive a fastener extending therethrough to secure the bracket to the structural member of the engine.

According to another aspect, the bracket includes a pair of flanges extending from opposite sides of the hub, each flange including a bore adapted to receive a fastener extending therethrough to secure the bracket to the structural member of the engine.

According to another aspect, the bracket is adapted to be mounted onto a surface of an engine block of the engine.

According to several aspects of the present disclosure, a method of using a valvetrain service tool comprises mounting a valvetrain service tool onto a structural member of an engine, sliding a pin of the valvetrain service tool from a first position to a second position, wherein a first distal end of the pin engages a cam sprocket of the engine, sliding the pin, along with the cam sprocket supported thereon, from the second position to the first position, servicing a valvetrain component of the engine while the cam sprocket is supported on the first distal end of the pin, sliding the pin, along with the cam sprocket supported thereon, from the first position to the second position, sliding the pin of the valvetrain service tool from the second position to the first position and dis-engaging the first distal end of the pin from the cam sprocket of the engine, and removing the valvetrain service tool from the structural member of the engine.

According to another aspect, the method further includes dis-engaging a valvetrain component from the cam sprocket prior to sliding the pin, along with the cam sprocket supported thereon, from the second position to the first position, and engaging the valvetrain component with the cam sprocket after sliding the pin, along with the cam sprocket supported thereon, from the first position to the second position.

According to another aspect, the method further includes locking a flywheel of the engine in position prior to servicing a valvetrain component of the engine.

According to another aspect, the method further includes locking a flywheel of the engine in position with a dedicated locking tool adapted to keep the flywheel stationary.

According to another aspect, the method further includes locking camshafts of the engine in position prior to servicing a valvetrain component of the engine.

According to another aspect, the method further includes locking camshafts of the engine in position with a dedicated cam locking tool adapted to keep the camshafts stationary and maintain proper phasing.

According to several aspect of the present disclosure, a valvetrain service tool for an automobile engine comprises a bracket adapted to be removably mounted onto a surface of an engine block of an engine, the bracket including a hub having a cylindrical bore formed therein, a slot formed within the hub extending longitudinally along the cylindrical bore, and a pair of flanges extending from opposite sides of the hub, each flange including a bore adapted to receive a fastener extending therethrough to secure the bracket to the engine block, and a pin slidably supported within the cylindrical bore and slidable longitudinally within the cylindrical bore between a first position and a second position, the pin including a stop extending radially from an outer diameter of the pin and through the slot formed within the bracket, wherein the stop secures the pin within the cylindrical bore of the bracket and when the pin is in the first position the stop is adjacent a first end of the slot and when the pin is in the second position the stop is adjacent a second end of the slot, further wherein, when the pin is moved from the first position to the second position, a first distal end of the pin engages a cam sprocket of the engine to support the cam sprocket and allow service to be performed to the valvetrain of the engine without removing the cam sprocket.

According to another aspect, the stop is a set screw having a textured head and the pin includes a threaded bore formed therein, the set screw being removably threaded within the threaded bore formed within the pin and the textured head adapted to allow the set screw to be manually threaded into the threaded bore formed within the pin or removed from the threaded bore formed within the pin to allow removal of the pin from the bracket.

According to another aspect, pin includes a knob attached to a second distal end adapted to allow the pin to be manually moved within the cylindrical bore of the bracket.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
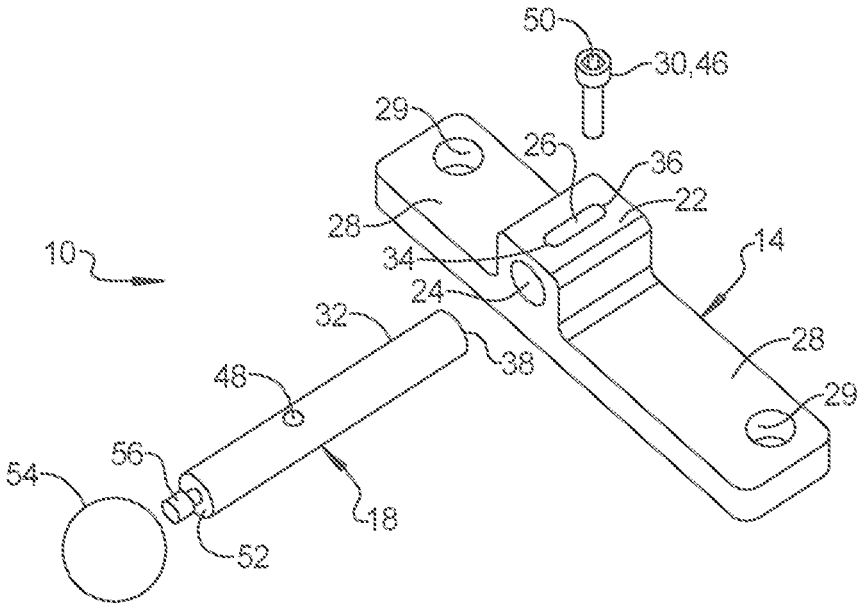
FIG. 1 is an exploded view of a valvetrain service tool of the present disclosure according to an exemplary embodiment.
Figure 2:
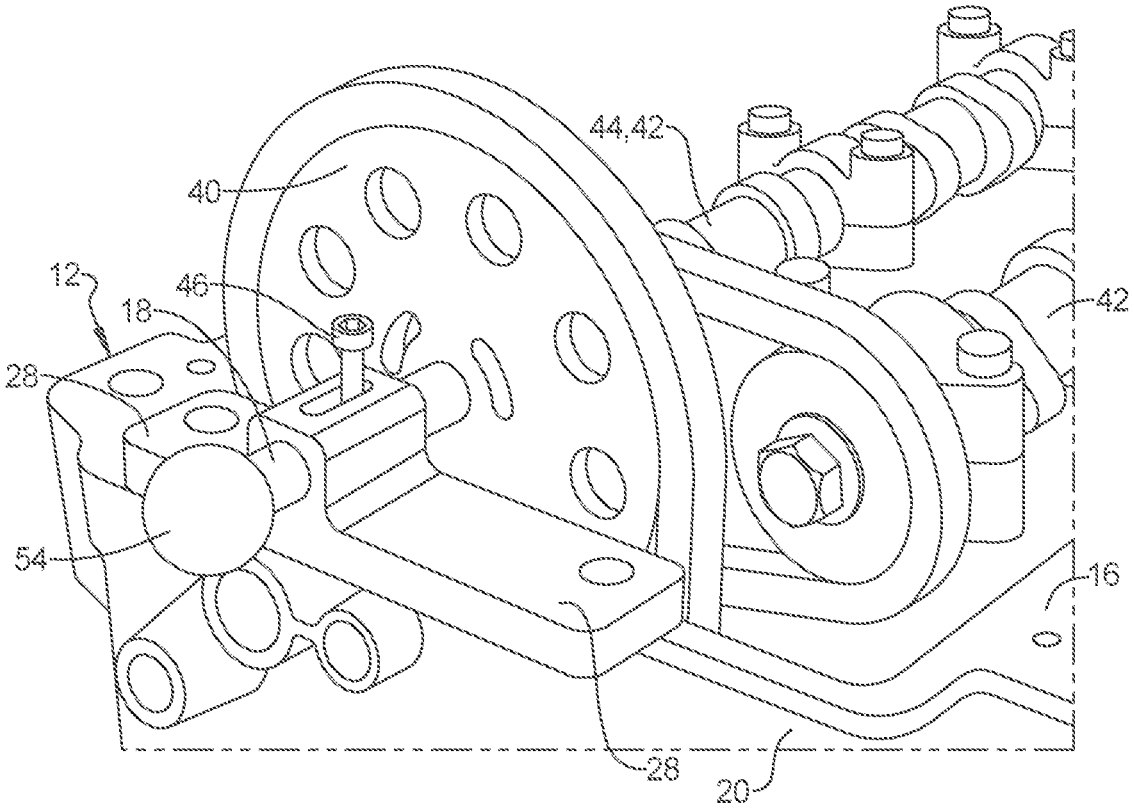
FIG. 2 is a perspective view of the valvetrain service tool of claim 1 mounted onto an engine.

Referring to FIGS. 1 and 2, a valvetrain service tool 10 for an automobile engine 12 comprises a bracket 14 adapted to be removably mounted onto a structural member 16 of the engine, and a pin 18 slidably supported within the bracket 14. As shown herein, the structural member 16 is a surface of the engine block 20 for the engine 12. It should be understood that the valvetrain service tool 10 could be mounted to other structural members of the engine 12.

The bracket 14 includes a hub 22 having a cylindrical bore 24 formed therein, a slot 26 formed within the hub 22 extending longitudinally along the cylindrical bore 24, and a pair of flanges 28 extending from opposite sides of the hub 22. Each flange 26 includes a bore 29 adapted to receive a fastener extending therethrough to secure the bracket 14 to the engine block 20.

The pin 18 is slidably supported within the cylindrical bore 24 and is slidable longitudinally within the cylindrical bore 24 between a first position and a second position. The pin 18 includes a stop 30 extending radially from an outer diameter 32 of the pin 18 and through the slot 26 formed within the bracket 14, wherein the stop 30 secures the pin 18 within the cylindrical bore 24 of the bracket 14. When the pin 18 is in the first position the stop 30 is adjacent a first end 34 of the slot 26 and when the pin 18 is in the second position the stop 30 is adjacent a second end 36 of the slot 26.

When the pin 18 is moved from the first position to the second position, a first distal end 38 of the pin 18 engages a cam sprocket 40 of the engine 12 to support the cam sprocket 40 and allow service to be performed to the valvetrain of the engine 12 without removing the cam sprocket 40. The pin 18 will support the cam sprocket 40 to allow valvetrain components 42 such as the cam shaft 44 to be removed from the engine 12.

As shown, the stop 30 is a set screw 46. The pin 18 includes a threaded bore 48 formed therein and the set screw 46 is removably threaded within the threaded bore 48 formed within the pin 18. The set screw 46 further includes a textured head 50 that provides an engagement point to allow the set screw 46 to be manually threaded into the threaded bore 48 formed within the pin 18. Alternatively, the textured head 50 of the set screw 46 also allows the set screw 46 to be manually removed from the threaded bore 48 formed within the pin 18, allowing removal of the pin 18 from the bracket 14.

A second distal end 52 of the pin 18, opposite the first distal end 38, includes a knob 54 that provides an engagement point to allow the pin 18 to be manually moved within the cylindrical bore 24 of the bracket 14. As shown, the second distal end 52 of the pin 18 includes a threaded nipple 56 and the knob 54 includes a threaded bore 58. The knob 54 is held onto the pin 18 by a threaded engagement of the threaded nipple 56 within the threaded bore 58 of the knob 54.

Figure 3:
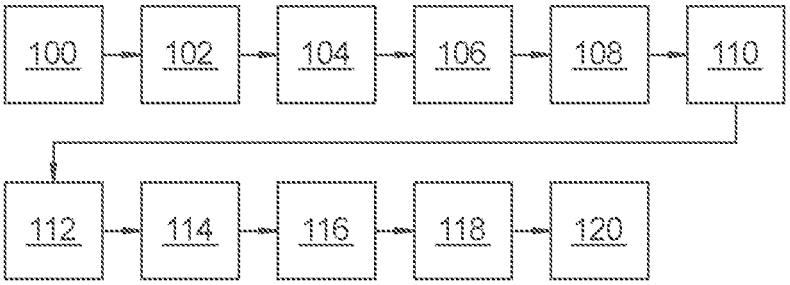
FIG. 3 is flowchart illustrating a method of using a valvetrain service tool according to an exemplary embodiment.

Referring to FIG. 3, a flow chart illustrating a method of using the valvetrain service tool 10 is shown. Beginning at block 100, the method includes mounting the valvetrain service tool 10 onto a structural member 16 of an engine 12. As mentioned above, the structural member 16 of the engine 12 may be the engine block 20. Moving to block 102, the pin 18 of the valvetrain service tool 10 is slid from the first position to the second position where the first distal end 38 of the pin 18 engages the cam sprocket 40 of the engine 12, as shown in FIG. 4.

Moving to block 104, the method includes locking a flywheel of the engine 12 in position with a dedicated locking tool adapted to keep the flywheel stationary. Various types of dedicated locking tools adapted to keep the flywheel of the engine 12 stationary are known and used regularly in the repair of automobile engines. Additionally, moving on to block 106, the method includes locking camshafts 44 of the engine 12 in position. Various types of dedicated locking tools adapted to keep the camshafts 44 of the engine 12 stationary are known and used regularly in the repair of automobile engines. Locking the flywheel and camshafts 44 in position will ensure proper phasing of the cam sprocket 40 is maintained.

Figure 4:
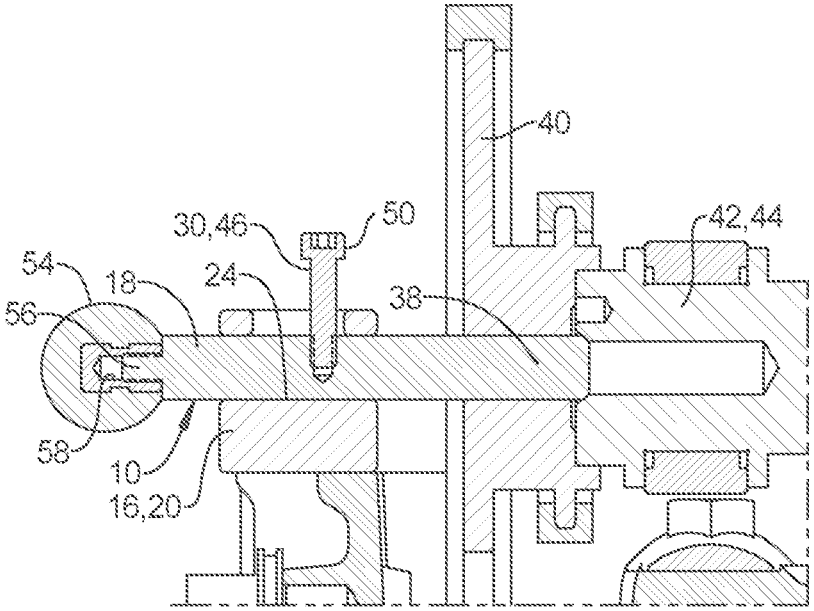
FIG. 4 is a sectional schematic of the valvetrain service tool shown in FIG. 2, wherein the pin is in the second position.
Figure 5:
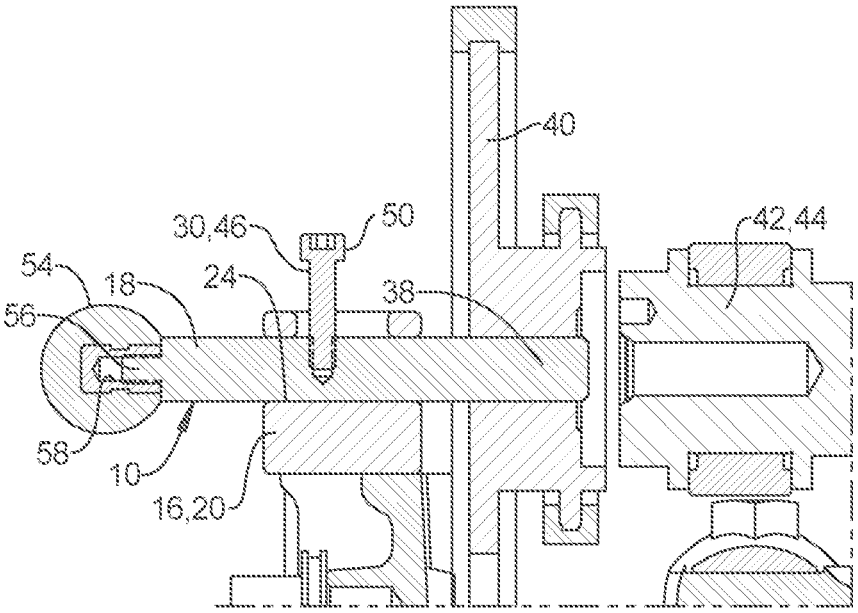
FIG. 5 is a sectional schematic of the valvetrain service tool shown in FIG. 2, wherein the pin is in the first position.

Moving on to block 108, once the pin 18 and the cam sprocket 40 are engaged, as shown in FIG. 4, the valvetrain component 42, such as the cam shaft 44, that is to be serviced is dis-engaged from the cam sprocket 40. Now moving on to block 110, the method includes sliding the pin 18, along with the cam sprocket 40 supported thereon, from the second position to the first position, as shown in FIG. 5. The valvetrain component 42, as shown herein the camshaft 44, is now free of the cam sprocket 40 and can be removed from the engine 12 for service.

Moving to block 112, with the cam sprocket 40 supported on the first distal end 38 of the pin 18, the valvetrain components 42, such as the camshaft 44, are serviced. The valvetrain component 42 may be repaired or replaced as needed. Moving to block 114, once the valvetrain component 42 or components 42 are serviced and replaced within the engine 12, the pin 18 is slid, along with the cam sprocket 40 supported thereon, from the first position, as shown in FIG. 5, back to the second position, as shown in FIG. 4.

Moving to block 116, the method further includes engaging the valvetrain component 42 with the cam sprocket 40. Once the valvetrain component 42 and the cam sprocket 40 are engaged, moving to block 118, the method includes sliding the pin 18 of the valvetrain service tool 10 from the second position to the first position and dis-engaging the first distal end 38 of the pin 18 from the cam sprocket 40 of the engine 12. Finally, moving to block 120, the valvetrain service tool 10 is removed from the structural member 16 of the engine 12.

A valvetrain service tool of the present disclosure offers the advantage of being able to service various components of the valvetrain within an automobile engine without having to remove the cam sprocket and related components. This saves time and cost associated with providing such repairs to an automobile.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A valvetrain service tool for an automobile engine, comprising:

a bracket removably mounted onto a structural member of an engine, the bracket including:

a hub having a cylindrical bore formed therein, a pin supported within the cylindrical bore and slidable longitudinally within the cylindrical bore; and a slot formed therein, the slot extending longitudinally along the cylindrical bore, and the pin includes a stop extending radially from an outer diameter of the pin, the stop extending through the slot formed within the bracket, wherein the stop secures the pin within the cylindrical bore of the bracket and when the pin is in a first position the stop is adjacent a first end of the slot and when the pin is in a second position the stop is adjacent a second end of the slot; and the pin slidably supported within the bracket;

wherein the pin is slidable between the first position and the second position and when the pin is moved from the first position to the second position, the pin engages a cam sprocket of the engine to support the cam sprocket to allow service to be performed to the valvetrain of the engine without removing the cam sprocket.

2. The valvetrain service tool of claim 1, wherein the stop is a set screw and the pin includes a threaded bore formed therein, the set screw being removably threaded within the threaded bore formed within the pin.

3. The valvetrain service tool of claim 2, wherein the set screw further includes a textured head adapted to allow the set screw to be manually threaded into the threaded bore formed within the pin.

4. The valvetrain service tool of claim 3, wherein the textured head of the set screw is further adapted to allow the set screw to be manually removed from the threaded bore formed within the pin to allow removal of the pin from the bracket.

5. The valvetrain service tool of claim 1, wherein the pin includes a first distal end that engages the cam sprocket of the engine when the pin is in the second position, and a second distal end, opposite the first distal end, wherein the pin includes a knob attached to the second distal end adapted to allow the pin to be manually moved within the cylindrical bore of the bracket.

6. The valvetrain service tool of claim 5, wherein the second distal end of the pin includes a threaded nipple and the knob includes a threaded bore, further wherein the knob is held onto the pin by a threaded engagement of the threaded nipple within the threaded bore of the knob.

7. The valvetrain service tool of claim 6, wherein the bracket includes at least one flange extending from the hub, the flange including a bore adapted to receive a fastener extending therethrough to secure the bracket to the structural member of the engine.

8. The valvetrain service tool of claim 6, wherein the bracket includes a pair of flanges extending from opposite sides of the hub, each flange including a bore adapted to receive a fastener extending therethrough to secure the bracket to the structural member of the engine.

9. The valvetrain service tool of claim 6, wherein the bracket is removably mounted onto a surface of an engine block of the engine.

10. A method of servicing the valvetrain of an automotive engine comprising:

sliding a pin of a valvetrain service tool from a first position to a second position, wherein the valvetrain service tool includes:

a bracket removably mounted onto a surface of an engine block of the automotive engine, the bracket including a hub having a cylindrical bore formed therein, a slot formed within the hub extending longitudinally along the cylindrical bore, and a pair of flanges extending from opposite sides of the hub, each flange including a bore adapted to receive a fastener extending therethrough to secure the bracket to the engine block;

the pin slidably supported within the cylindrical bore and slidable longitudinally within the cylindrical bore between the first position and the second position, the pin including a stop extending radially from an outer diameter of the pin and through the slot formed within the bracket, wherein the stop secures the pin within the cylindrical bore of the bracket and when the pin is in the first position the stop is adjacent a first end of the slot and when the pin is in the second position the stop is adjacent a second end of the slot; and wherein, when the pin is moved from the first position to the second position, a first distal end of the pin engages a cam sprocket of the engine;

dis-engaging a valvetrain component from the cam sprocket;

sliding the pin, along with the cam sprocket supported thereon, from the second position to the first position;

servicing a valvetrain component of the engine while the cam sprocket is supported on the first distal end of the pin;

sliding the pin, along with the cam sprocket supported thereon, from the first position to the second position;

engaging the valvetrain component with the cam sprocket; and sliding the pin of the valvetrain service tool from the second position to the first position and dis-engaging the first distal end of the pin from the cam sprocket of the engine.

11. The method of servicing the valvetrain of an automotive engine of claim 10, further including locking a flywheel of the engine in position with a dedicated locking tool adapted to keep the flywheel stationary, and locking camshafts of the engine in position with a dedicated cam locking tool adapted to keep the camshafts stationary and maintain proper phasing prior to servicing a valvetrain component of the engine.

12. An automotive engine, comprising:

an engine block; and a valvetrain service tool removably mounted onto the engine block, the valvetrain service tool including:

a bracket including a hub having a cylindrical bore formed therein, a slot formed within the hub extending longitudinally along the cylindrical bore, and a pair of flanges extending from opposite sides of the hub, each flange including a bore adapted to receive a fastener extending therethrough to secure the bracket to the engine block;

a pin slidably supported within the cylindrical bore and slidable longitudinally within the cylindrical bore between a first position and a second position, the pin including a stop extending radially from an outer diameter of the pin and through the slot formed within the bracket, wherein the stop secures the pin within the cylindrical bore of the bracket and when the pin is in the first position the stop is adjacent a first end of the slot and when the pin is in the second position the stop is adjacent a second end of the slot; and wherein, when the pin is moved from the first position to the second position, a first distal end of the pin engages a cam sprocket of the engine to support the cam sprocket and allow service to be performed to the valvetrain of the engine without removing the cam sprocket.

13. The automotive engine of claim 12, wherein the stop is a set screw having a textured head and the pin includes a threaded bore formed therein, the set screw being removably threaded within the threaded bore formed within the pin and the textured head adapted to allow the set screw to be manually threaded into the threaded bore formed within the pin or removed from the threaded bore formed within the pin to allow removal of the pin from the bracket.

14. The automotive engine of claim 13, wherein the pin includes a knob attached to a second distal end adapted to allow the pin to be manually moved within the cylindrical bore of the bracket.

* * * * *